US009180931B2

(12) United States Patent
Hou et al.

(10) Patent No.: US 9,180,931 B2
(45) Date of Patent: Nov. 10, 2015

(54) PADDLE WHEEL YACHT

(75) Inventors: Liang Hou, Chongqing (CN); Yuhan Hou, Chongqing (CN); Fengqin Jia, Chongqing (CN)

(73) Assignee: CHONGQING YUNHAN MARINE TECHNOLOGY CO., LTD., Chongqing (CN)

( * ) Notice: Subject to any disclaimer, the term of this patent is extended or adjusted under 35 U.S.C. 154(b) by 113 days.

(21) Appl. No.: 13/574,415

(22) PCT Filed: Jan. 28, 2011

(86) PCT No.: PCT/CN2011/070759

§ 371 (c)(1), (2), (4) Date: Sep. 13, 2012

(87) PCT Pub. No.: WO2011/095113

PCT Pub. Date: Aug. 11, 2011

(65) Prior Publication Data

US 2013/0000537 A1 Jan. 3, 2013

(30) Foreign Application Priority Data

Feb. 8, 2010 (CN) ..... 2010 1 9097003

(51) Int. Cl.

| | |
|---|---|
| ***B63H 5/03*** | (2006.01) |
| ***B63B 1/00*** | (2006.01) |
| ***B63B 1/16*** | (2006.01) |
| ***B63H 5/02*** | (2006.01) |
| *B63B 1/20* | (2006.01) |

(52) U.S. Cl.

CPC .. *B63B 1/16* (2013.01); *B63H 5/02* (2013.01); *B63B 2001/203* (2013.01); *B63H 5/03* (2013.01)

(58) Field of Classification Search

CPC ..... B63H 5/02; B63B 1/12; B63B 1/16
USPC ..... 440/90–93; 114/61.1
See application file for complete search history.

(56) References Cited

U.S. PATENT DOCUMENTS

| | | | | |
|---|---|---|---|---|
| 769,484 | A * | 9/1904 | Lomb | 440/90 |
| 935,198 | A * | 9/1909 | Fletcher | 440/91 |
| 4,171,675 | A * | 10/1979 | Thompson | 440/90 |
| 4,644,890 | A | 2/1987 | Lott | |
| 6,736,080 | B2 * | 5/2004 | Armstrong | 114/61.11 |

FOREIGN PATENT DOCUMENTS

| | | |
|---|---|---|
| CN | 1068995 A | 2/1993 |
| CN | 101875394 A | 11/2010 |
| RU | 2107009 | 6/1992 |

* cited by examiner

*Primary Examiner* — Lars A Olson
*Assistant Examiner* — Andrew Polay
(74) *Attorney, Agent, or Firm* — Myron Greenspan Lackenbach Siegel LLP

(57) ABSTRACT

A paddle wheel yacht includes a ship body and a ship power device that is arranged on the ship body and consists of a propeller driven by a main engine. The propeller consists of two paddle wheels. The lower edges of the paddle wheels are lower than the bottom surface of the ship body and are symmetrically arranged on the two sides of the ship body. Paddles are uniformly distributed on the outer edges of the paddle wheels in the radial direction and continuously flap the water surface down-backward at high speed when the paddle wheels rotate at high speed. Only the tail part of the ship body contacts with the water surface and the ship body slides on the water surface, so as to avoid large water resistance and obviously improve the propulsion efficiency to realize the high speed and economical navigation of the ship.

11 Claims, 3 Drawing Sheets

PADDLE WHEEL YACHT

FIELD OF INVENTION

The present invention relates to a paddle wheel ship. In particular, the present invention relates to a paddle wheel yacht.

BACKGROUND OF INVENTION

The paddle wheel ship was once prevailing in the steam era, yet it is a kind of ship of low speed and poor efficiency whose place had been taken by propeller-driven ship back long, this is the common view in this field; Modern fast-speed-capable ships includes planing boat as well as hydrofoil, both primarily relies on propeller to drive. While sailing at high speed, planning boat or hydrofoil depends on hydrodynamic pressure or hydro-lift force respectively to support the gravity, the majority of the ship will be elevated to reduce water resistance; however, as the speed ascends, serious torsional force and cavitation of the rotating propeller will waste power and the efficiency descends substantially, therefore, for propeller ship to achieve high speed navigation will necessitate engine of higher power, to exchange high energy for high speed, it is economically unwise.

Also, the propeller yacht may pitch upward or even flip over if it encounters surge during abrupt acceleration or high speed navigation, it is hence of poor stability and seakeeping performance.

People never ceased their effort to seek for over water carrier of higher efficiency and speed, and those animals what can go free over the water had always been the inspiration for people to imitate and design. Take the basilisk lizard in South America for example, it posses a unique ability to run over water with its body and forelegs untouched from the water while its hind legs treading and its tail to balance and steer, people was inspired a lot from it.

Although paddle wheel ship had disappeared for a long time, yet its propeller can be used for the inventor to build this, to some extent, bionic paddle wheel yacht.

SUMMARY OF THE INVENTION

The purpose of the present invention is to provide a paddle wheel yacht which can maintain high propulsive efficiency during high speed sailing.

To achieve the preceding purpose, the present invention can adopt the following solution:

The paddle wheel yacht in the invention includes a hull and a power unit in the hull, the power unit consists of an engine-driven propeller. The propeller consists of two symmetrically arranged paddle wheels on the two sides of the hull. The lower edges of the paddle wheels are lower than the hull bottom.

A rudder is installed in the rear of the hull.

Further, the paddle wheels are arranged on the two sides at the half-length of the hull.

The hull bottom is plane surface.

Further, the hull bottom is arc-shaped upturned in the front to form a streamlined surface toward the water.

The hull is a triple-hulled vessel of two sub-hulls and one main hull, the two sub-hulls are arranged symmetrically on the front-nearing two sides of the hull.

Similarly, the bottom of the sub-hulls and the main hull are plane surfaces, and are arc-shaped upturned in the front to form a streamlined surface toward the water.

Further, the bottom of the sub-hulls are lower than the bottom of the main hull.

Further on, the bottoms of the sub-hulls are parallel to the bottom of the main hull.

The symmetrically arranged paddle wheels on the two sides of the hull are upward and downward synchronously adjustable, and/or forward and backward synchronously adjustable.

The advantages of the present invention are the combination of modern engine and conventional paddle wheel propeller, by means of having the bottom surfaces of the two symmetrical paddle wheels on the two sides of the hull lower than the bottom face of the hull, when the paddle wheel rotate at a high speed, the uniformly distributed paddles on the edges of the paddle wheels in the radial direction will continuously flap the water surface down-backward at a high speed, due to the high density of the water, sufficient back force can be gained, with its upward component force of the back force, the ship will be propped up over the water, and with its forward component force, the ship will be propelled onward, as a result, all that left to touch the water is only the rear part of the ship to balance the ship while the ship is advancing, which greatly eliminates the water resistance and significantly improve propulsional efficiency, and the objective of high-speed sailing at a lower cost will be attained.

The ship model test had proved that a ship model employing the structure of the present invention, with equal terms on power output, hull weight and hull size, can be 50% faster than the planing boat model employing propeller, this is a substantial breakthrough in velocity.

It is also proved by the ship model test that upon abrupt acceleration or encountering surge while sailing at high speed and the ship model begin to pitch up and the paddle wheels detach the water, the ship model employing the structure of the present invention will automatically loss velocity and prevent the boat from flipping over. Therefore, the present invention possesses prominent stability and seakeeping performance.

Posed over water while advancing, the present invention is able to go over floaters and substantially reduce the impact from floaters to the hull and the paddle wheel, or in exceptional circumstances, even perform assault landing.

Although the present invention share a similar appearance with conventional paddle wheel ship, but the key structure and the operation mode are totally distinct:

a. The lower edges of the paddle wheels are lower than the bottom of the hull, rather than higher;
b. The paddle wheels are flapping, as opposed to pulling;
c. The gravity of the hull is propped by the upward component force of the back force from the flapping of the paddle wheel, instead of by buoyancy.
d. The hull is taxiing over the water, in place of in it.
e. The major resistance is from air, not from water.

Thereby, the present invention is no duplication of the conventional paddle wheel ship but a brand new ship type.

The essential difference between the presenting invention and the propeller yacht is rooted in: While sailing at a high speed, the propulsive efficiency of the paddle wheel is proportional to the velocity while the propulsive efficiency of the propeller is inversely proportional to the velocity. Thus, the speed performance of the present invention is superior to propeller yacht.

The preceding hull force analysis indicates that the present invention is not displacement hull or planing boat, hydrofoil or hover craft, but a breakthrough, an innovation and a successful application of bionics in marine technology.

DESCRIPTION OF THE DRAWINGS

FIG. 2-1 shows the front view of the sailing hull of embodiment 1.

FIG. 2-2 shows the top view of FIG. 2-1.

FIG. 3-1 shows the front view of the sailing hull of embodiment 2.

FIG. 3-2 shows the front view of the anchored hull of embodiment 2.

FIG. 3-3 shows the top view of FIG. 3-2.

DESCRIPTION OF THE INVENTION

Figure 1:
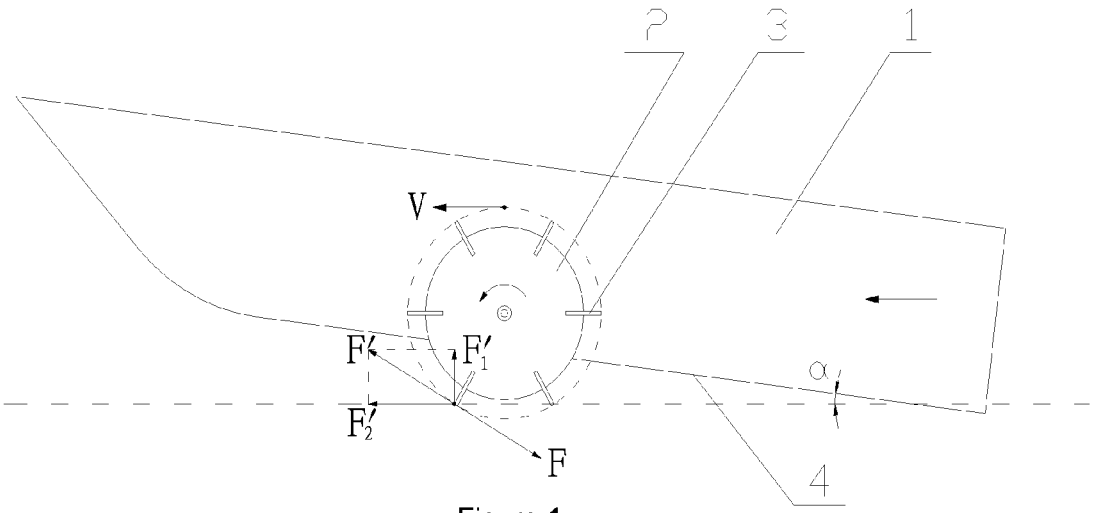
FIG. 1 shows the principle of the present invention.

FIG. 1 illustrated the principle of the present invention while sailing. Paddle wheels 2 are arranged at the lengthways middle part and on the two sides of the hull 1 with their lower edges lower than the hull bottom 4, with the driving force from the engine, the paddle wheels 2 rotate forward at high speed and the paddles 3 on it will continuously flap the water surface down-backward at high speed to generate a F force, at the same time, the paddles 3 will get a equal back force F', the upward component force F'1 will prop the hull 1 to leap out of the water and the forward component force F'2 will propel the hull 1 to move onward, only the tail of the hull 1 touches the water and taxies over the water, thereby eliminates most of the water resistance while the hull 1 is sailing and the power outputted from the engine will primarily goes to overcome the air resistance, which substantially improve the propulsive efficiency, when the tangential velocity at the edges of paddles 3 exceeds 50 km/h, the propulsive efficiency will be further improved. The engine of the embodiments of the present invention could be electric motor, combustion motor, steam turbine or gas turbine etc.

Embodiment 1

Figures 1, 2:
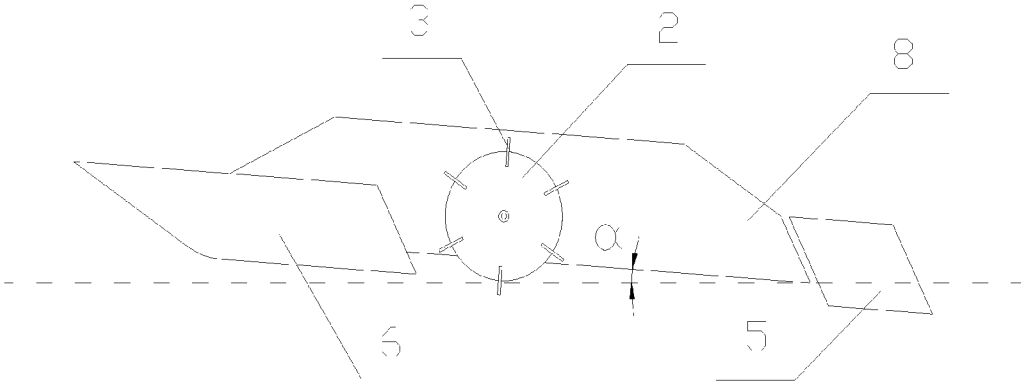
Figure 2:
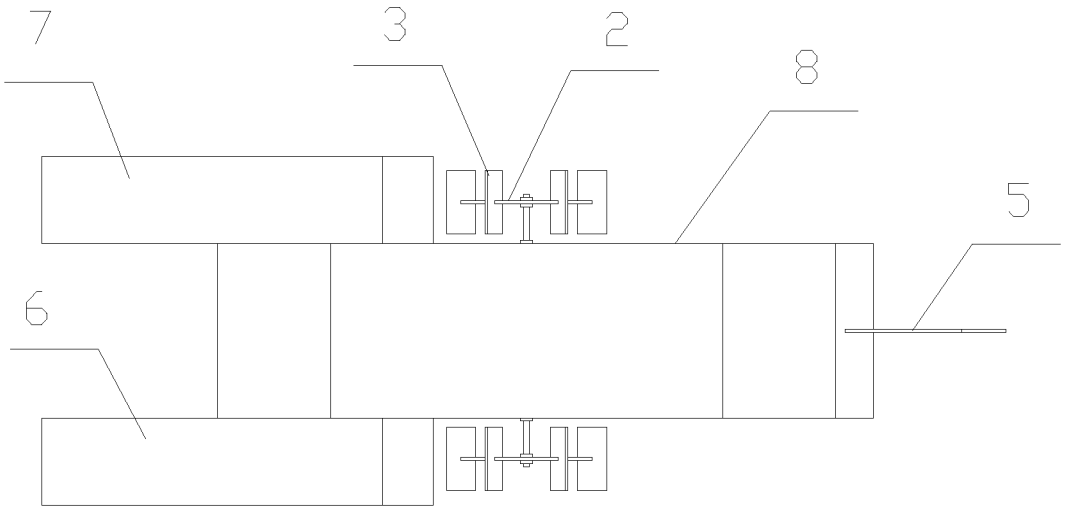

As illustrated in FIG. 2-1 and FIG. 2-2, the embodiment of the present invention includes hull, the power device that is arranged on the hull and consists of a propeller driven by a engine; The hull is triple-hulled, the two of sub-hull 6 and sub-hull 7 are set parallel and symmetrically on the front-nearing two sides of the main hull 8, the sub-hull 6 and sub-hull 7 have their bottom surface lower than that of the main-hull 8 and both bottom surfaces of the sub-hull 6 and the sub-hull 7 are plane surfaces with their front arc-shaped upturned to form a streamlined surface toward the water; A rudder 5 is installed in the rear of the main hull 8; The propeller consists of two symmetrically installed paddle wheels 2 at the lengthways middle part of the main hull 8; the lower edges of the paddle wheels 2 are lower than the bottom surface of the main hull 8; The installation of the two of sub-hull 6 and sub-hull 7 not only improves the static buoyancy but also protects the paddle wheels 2 while sailing, in the meanwhile the sub-hull 6 and the sub-hull 7 make the hull bottom to form an elevation angle $\alpha$ to the water surface and change the relative height of paddle wheels 2, sub-hull 6 and sub-hull 7 over the bottom surface of the main hull, which is, the elevation angle $\alpha$ is adjustable at sailing, when the elevation angle $\alpha$ belongs to $0° < \alpha < 10°$, it is in favor of quick start and stable high speed taxiing, with the assistance of the rudder 5, the buoyancy, insubmersibility and controllability are superior.

Embodiment 2

Figures 1, 3:
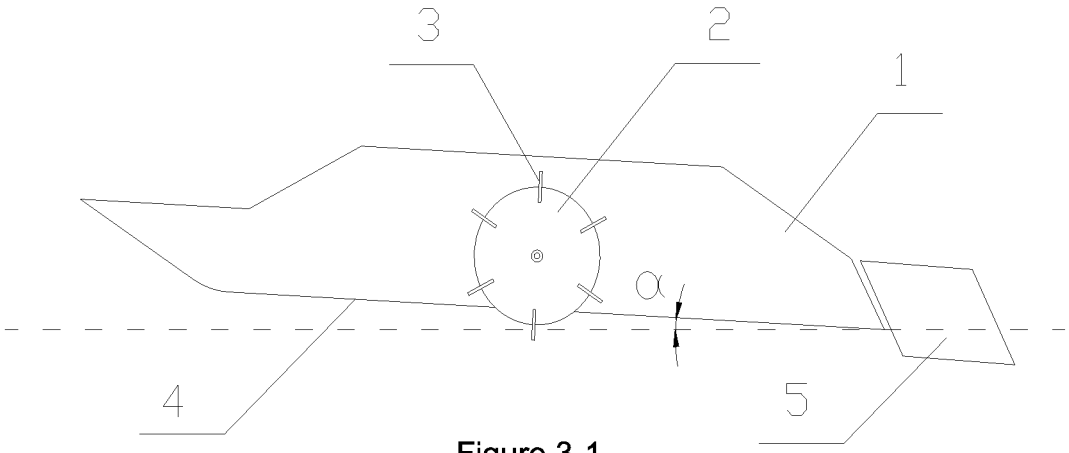
Figures 2, 3:
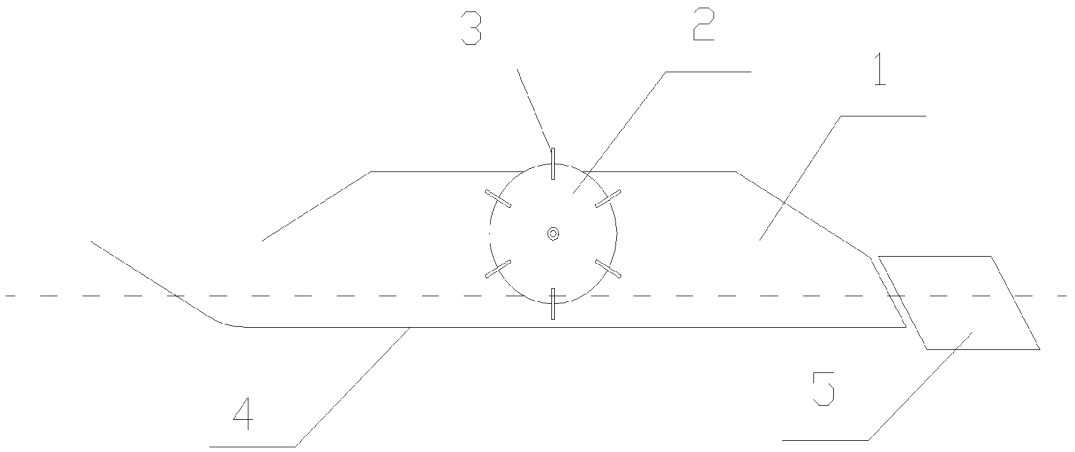
Figure 3:
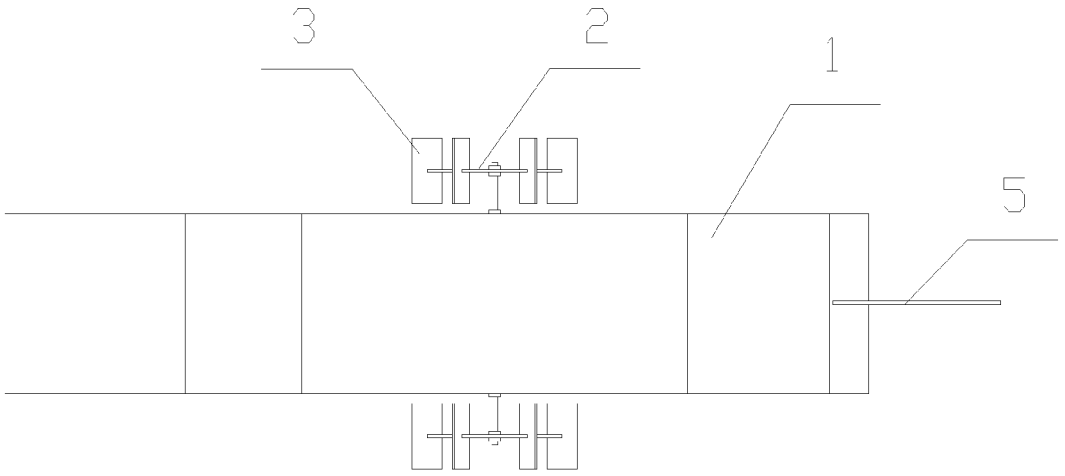

As illustrated by FIG. 3-1 and FIG. 3-3, the paddle wheel yacht in the present invention including. The power unit in the hull 1 consists of engine-driven propeller on the hull 1. The propeller consists of two symmetrically arranged paddle wheels 2 on the two sides and at the lengthways middle part of the hull 1. The lower edges of the paddle wheels 2 are lower than the hull bottom 4. A rudder 5 is installed in the rear of the hull 1.

To start quick, the axles of the paddle wheels 2 may be synchronously adjustable upward and downward, in specific, can employ conventional lift structures like screw or hydraulic. As showing in the FIG. 3-2, when the hull 1 is static, the axles of paddle wheels 2 can be adjusted upward to make the lower edges of the paddle wheels 2 higher than the hull bottom 4 but still underwater, that is the very status of the conventional paddle wheel ship, it may not sailing at a very high speed but it can start quick, and with the increase of velocity, the axles of the paddle wheels 2 can be re-adjusted downward to switch to the high speed sailing mode.

Similarly, the axles of the paddle wheels 2 can be synchronously adjustable forward and backward, it also can employ conventional push-and-pull structures like screw or hydraulic. Adjusting the paddle wheels 2 forward or backward basing on the speeds can change the elevation angle $\alpha$ of the hull to reduce the resistance and adapt the ship to the condition of the water.

What is claimed is:

1. A paddle wheel yacht, comprising:

a triple hull comprising a main central hull and two lateral sub-hulls, each of said hulls having substantially flat bottom surfaces, a power unit set in the main central hull, and the power unit consists of an engine-driven propeller;

the propeller comprises two symmetrically arranged paddle wheels on the two sides of the main hull, said lower edges of said paddle wheels reaching a position lower than the flat bottom surface of each sub-hull, said paddle wheels being arranged symmetrically on the two sides substantially midway between the aft and forward ends of the main central hull, the bottom surfaces of said sub-hulls being lower than the bottom surface of said main central hull to incline said flat surface of said main central hull to form an elevation angle $\alpha_0 > 0°$ relative to the water surface when the yacht is at rest and increase the height of said paddle wheels, said paddle wheels being rotatable by said engine to cause said paddles to continuously flap the water surface downwardly and rearwardly in relation to said hull to generate a force F and, at the same time, an equal back force F' being applied to said paddles, an upward component force $F_1'$ being sufficient to prop the forward portion of the main central hull to increase the angle $\alpha > \alpha_0$ and a forward component force $F_2'$ to propel the hull to move forward when a tangential velocity at the edges of paddles exceed 50 km/h, characterized in that the bottoms of said sub-hulls are parallel to the bottom of said main hull and a portion of the subhulls are forward of the main hull.

2. The paddle wheel yacht according to claim 1, characterized in that the symmetrically arranged paddle wheels on the two sides of the hull are upward and downward synchronously adjustable, and/or forward and backward synchronously adjustable.

3. The paddle wheel yacht according to claim 1, wherein said hull is triple hulled which consists of two sub-hulls and one main hull, the sub-hulls being symmetrically arranged on the two sides of the front of the main hull.

4. A paddle wheel yacht defining a plane of symmetry extending between the forward and aft position of the yacht, comprising:

a flat bottom hull that defines a water line coextensive with the surface of a body of water that supports the yacht by buoyancy when the yacht is at rest, a power unit set in the hull, and the power unit consists of an engine-driven propeller rotatably mounted on a generally horizontal shaft wherein the shaft is positioned above the water surface and spaced a predetermined normal distance h from said water line;

the propeller consists of two symmetrically arranged paddle wheels on the two sides of the hull mounted on said shaft for rotation therewith, each paddle wheel comprising a circular wheel arranged in a paddle plane generally normal to said shaft and parallel to said plane of symmetry; a plurality of radial paddles each having a generally flat surface and angularly spaced from each other relative to said shaft and having radially outermost tips, each paddle wheel extending through said flat surfaces of said paddles and having a radius r between said shaft and said outermost tips; and said paddle wheels being positioned at the lengthwise middle part of the hull; and said paddle wheels and paddles, with exception of said outermost tips, being positioned above the water surface when said power unit causes the yacht operate in a planing mode and h is smaller than r;

said paddle wheels being rotatable by said engine to cause said paddles to continuously flap the water surface downwardly and rearwardly in relation to said hull to generate a force F and, at the same time, an equal back force F' being applied to said paddles, an upward component force $F_1$' being sufficient to prop the forward portion of the main central hull and a forward component force $F_2$' to propel the hull to move forward when a tangential velocity at the edges of paddles exceed 50 km/h, characterized in that the said hull is triple-hulled which consists of two flat bottomed sub-hulls and one main hull, the sub-hulls are symmetrically arranged on the two sides and in front of the front of the main hull, characterized in that the symmetrically arranged paddle wheels on the two sides of the hull are upward and downward synchronously adjustable.

5. The paddle wheel yacht according to claim 4, wherein each of said paddles has a generally rectangular surface area.

6. The paddle wheel yacht according to claim 5, wherein each paddle wheel extends through and is joined to a central point of said paddle rectangular surface area of an associated paddle mounted on a supporting paddle wheel.

7. The paddle wheel yacht according to claim 4, characterized in that the bottoms of the said sub-hulls are lower than and parallel to the bottom of the main hull to orient or incline said flat surface of said main central hull to form an elevation angle $\alpha 0>0°$ relative to the water surface when the yacht is at rest or is sailing and increase the height of said paddle wheels to enable a planing start.

8. The paddle wheel yacht according to claim 1, characterized in that the elevation angle $10°>\alpha_0>0°$.

9. The paddle wheel yacht according to claim 7, characterized in that the elevation angle $10°>\alpha_0>0°$.

10. The paddle wheel yacht according to claim 7, characterized in that the lowest one of the outermost tips spaces a normal distance d from said water line when the paddle wheel yacht is sailing, and r=h+d.

11. A paddle wheel yacht defining a plane of symmetry extending between the forward and aft position of the yacht, comprising:

a flat bottom hull that defines a water line coextensive with the surface of a body of water that supports the yacht by buoyancy when the yacht is at rest, a power unit set in the hull, and the power unit consists of an engine-driven propeller rotatably mounted on a generally horizontal shaft wherein the shaft is positioned above the water surface and spaced a predetermined normal distance h from said water line;

the propeller consists of two symmetrically arranged paddle wheels on the two sides of the hull mounted on said shaft for rotation therewith, each paddle wheel comprising a circular wheel arranged in a paddle plane generally normal to said shaft and parallel to said plane of symmetry; a plurality of radial paddles each having a generally flat surface and angularly spaced from each other relative to said shaft and having radially outermost tips, each paddle wheel extending through said flat surfaces of said paddles and having a radius r between said shaft and said outermost tips; and said paddle wheels being positioned at the lengthwise middle part of the hull; and said paddle wheels and paddles, with exception of said outermost tips, being positioned above the water surface when said power unit causes the yacht operate in a planing mode and h is smaller than r;

said paddle wheels being rotatable by said engine to cause said paddles to continuously flap the water surface downwardly and rearwardly in relation to said hull to generate a force F and, at the same time, an equal back force F' being applied to said paddles, an upward component force $F_1$' being sufficient to prop the forward portion of the main central hull and a forward component force $F_2$' to propel the hull to move forward when a tangential velocity at the edges of paddles exceed 50 km/h, characterized in that the said hull is triple-hulled which consists of two flat bottomed sub-hulls and one main hull, the sub-hulls are symmetrically arranged on the two sides and in front of the front of the main hull, characterized in that the symmetrically arranged paddle wheels on the two sides of the hull are forward and back synchronously adjustable.

* * * * *